US010329693B2

(12) United States Patent
Griesshammer et al.

(10) Patent No.: US 10,329,693 B2
(45) Date of Patent: Jun. 25, 2019

(54) SPINNING PREPARATION MACHINE

(71) Applicant: Maschinenfabrik Rieter AG, Winterthur (CH)

(72) Inventors: Christian Griesshammer, Winterthur (CH); Petr Haska, Ceska Trebova (CZ)

(73) Assignee: Maschinenfabrik Rieter AG, Winterthur (CH)

( * ) Notice: Subject to any disclaimer, the term of this patent is extended or adjusted under 35 U.S.C. 154(b) by 192 days.

(21) Appl. No.: 15/313,418

(22) PCT Filed: May 11, 2015

(86) PCT No.: PCT/IB2015/000662
§ 371 (c)(1),
(2) Date: Nov. 22, 2016

(87) PCT Pub. No.: WO2015/181600
PCT Pub. Date: Dec. 3, 2015

(65) Prior Publication Data

US 2017/0096752 A1 Apr. 6, 2017

(30) Foreign Application Priority Data

May 26, 2014 (CH) ..... 00796/14

(51) Int. Cl.
*D01H 7/92* (2006.01)
*D01H 9/18* (2006.01)

(52) U.S. Cl.
CPC ..... *D01H 7/92* (2013.01); *D01H 9/18* (2013.01)

(58) Field of Classification Search
CPC ..... D01H 7/92; D01H 9/18
See application file for complete search history.

(56) References Cited

U.S. PATENT DOCUMENTS 4,028,874 A 6/1977 Maag et al.
RE30,162 E * 12/1979 Komura ..... D01H 9/18 414/414

(Continued)

FOREIGN PATENT DOCUMENTS

DE 24 47 715 A1 4/1976
DE 39 08 462 A1 2/1990

(Continued)

OTHER PUBLICATIONS

Swiss Patent Office Search Report, dated Oct. 28, 2014.
PCT Search Report, dated Oct. 14, 2015.

*Primary Examiner* — Shaun R Hurley
*Assistant Examiner* — Andrew Wayne Sutton
(74) *Attorney, Agent, or Firm* — Dority & Manning, P.A.

(57) ABSTRACT

A spinning preparation machine has consolidating means for producing a roving from a fiber bundle and a drafting system for drafting the fiber bundle. The drafting system is arranged upstream of the consolidating means in a transport direction of the drafting system. A guide is arranged upstream of the drafting system for guiding the fiber bundle between a container providing the fiber bundle and the drafting system. The guide has a feed segment opposite from the drafting system and a delivery segment facing the drafting system. The spinning preparation machine has a winding device for winding the roving onto a tube, and a tube transport device for providing empty tubes and/or for removing tubes loaded with roving by the winding device. The tube transport device has a conveyor for transporting empty tubes and/or tubes loaded with roving, wherein the conveyors are arranged at least in part between the feed segment of the guide and the drafting system.

12 Claims, 2 Drawing Sheets

(56) References Cited

U.S. PATENT DOCUMENTS

| | | | | | |
|---|---|---|---|---|---|
| 4,353,467 | A | * | 10/1982 | Harzenmoser | B65H 67/06 209/559 |
| 4,548,029 | A | * | 10/1985 | Araki | D01H 9/18 57/267 |
| 4,907,755 | A | * | 3/1990 | Burysek | B65G 47/266 242/473.4 |
| 4,956,969 | A | * | 9/1990 | Raasch | D01H 9/008 57/264 |
| 5,136,833 | A | * | 8/1992 | Inger | D01H 9/16 242/476 |
| 5,222,350 | A | | 6/1993 | Bowman et al. | |
| 2015/0082766 | A1 | | 3/2015 | Stahlecker et al. | |

FOREIGN PATENT DOCUMENTS

| | | | |
|---|---|---|---|
| DE | 39 36 518 | A1 | 5/1991 |
| DE | 44 45 265 | A1 | 6/1996 |
| DE | 195 05 050 | A1 | 8/1996 |
| DE | 10 2012 102695 | A1 | 10/2013 |
| EP | 1 666 650 | A1 | 6/2006 |
| JP | S 50123943 | A | 9/1975 |
| WO | WO 2007/134806 | A | 11/2007 |
| WO | WO 2009/086646 | A1 | 7/2009 |

* cited by examiner

SPINNING PREPARATION MACHINE

FIELD OF THE INVENTION

The present invention relates to a spinning preparation machine having at least one consolidating means for producing a roving that has a protective twist and that is made of a fiber bundle supplied to the consolidating means. The machine has a drafting system for drafting the fiber bundle before the latter enters the consolidating means, wherein the drafting system is arranged upstream of the consolidating means in a transport direction of the drafting system. A guide is arranged upstream of the drafting system in the aforesaid transport direction for guiding the fiber bundle between a container providing the fiber bundle and the drafting system. The guide has a feed segment facing away from the drafting system for the fiber bundle originating from the container when the spinning preparation machine is in operation, and has a delivery segment facing the drafting system for the fiber bundle. The spinning preparation machine has a winding device for winding the roving onto a tube, a tube transport device for providing empty tubes and/or for removing tubes loaded with roving using the winding device.

BACKGROUND

Generic spinning preparation machines are known in the prior art and are used for producing so-called roving. Roving is produced from slivers which are in most cases pretreated (for example doubled) by means of drafting and serves as feed for the subsequent spinning process, in which the individual fibers of the roving are spun, for example by means of a ring spinning machine, to form a yarn. In order to give the roving the strength necessary for the further processing, it has proven to be advantageous, during production of the roving, to draft the supplied fiber bundle by means of a drafting system, which is usually part of the spinning preparation machine in question, and then to provide it with a protective twist. Said strength is important in order to prevent breaking of the roving during the winding onto a tube and/or during the feeding thereof to the downstream spinning machine. The applied protective twist must, on the one hand, be strong enough that a cohesion of the individual fibers during the individual winding and unwinding processes and corresponding transport processes between the respective types of machine is ensured. On the other hand, it must also be ensured that, despite the protective twist, the roving can be further processed in a spinning machine—the roving must therefore still be able to be drafted.

For producing such a roving, in the past so-called flyers were used, the delivery speed of which is nevertheless limited due to centrifugal forces that occur. There have therefore already been many proposals to avoid the flyers or to replace them with an alternative type of machine.

In this connection, it has also already been proposed, inter alia, to produce roving by means of air-jet spinning machines, in which the protective twist is created by means of swirled air flows. The basic principle here consists in guiding a fiber bundle through a consolidating means designed as an air spinning nozzle, in which an air vortex is generated. The latter finally effects that some of the outer fibers of the supplied fiber bundle are wrapped as so-called wrapping fibers around the centrally running fiber strand, which in turn consists of core fibers running substantially parallel to one another.

Another method for roving production is disclosed in DE 24 47 715 A1. The consolidation of the unconsolidated fiber bundle described therein takes place by a consolidating means which brings about not a twisting but rather a helical wrapping of a sliver with one or more filament yarns, preferably monofilament yarns, which hold the fiber bundle together and give it strength. The spirals of the individual filament yarns may in this case be arranged in the same direction or in opposite directions. Preference is given to two filament yarns which are arranged in opposite directions of rotation and in a manner crossing over one another. The roving produced in this way is thus composed essentially of a sliver of parallel staple fibers and one or more fine-titer filament yarns wrapping helically around the sliver.

There are various possibilities for wrapping the filament yarn or filament yarns around the unconsolidated fiber bundle. For example, the filament yarn can be applied onto small bobbins of small diameter. The filament yarn is then drawn off from the stationary bobbin and drawn through the bobbin axis together with the fiber bundle, whereby the filament yarn is wrapped around the fiber bundle and the number of windings drawn off from the bobbin corresponds to the number of wraparounds applied to the fiber bundle. In principle, it is also possible to design the consolidating means in such a way that only the unconsolidated fiber bundle is guided through the bobbin axis, so as to hereby relocate the winding process to behind the filament yarn bobbin. The wrapping point should in this case be defined by a suitable thread guide.

Another method for producing roving is described in WO 2009/086646 A1, wherein the method comprises the following steps: 1) providing a fiber bundle in the form of two, preferably untwisted, slivers, 2) applying S and Z twists over alternating regions of the two slivers, wherein regions of S and Z twists on the respective sliver are separated by regions without any twist, 3) bringing together the two slivers provided with S and Z twists to form a roving, wherein the two slivers automatically twist together on account of their tendency to twist back.

The S and Z twists may be created for example by means of two elements of the consolidating means used, which hold the respective sliver in a clamped manner, wherein at least one element, preferably both elements, apply opposite twists on the sliver in an alternating manner on both sides by a relative movement on the surface thereof transversely to the longitudinal direction of the sliver. At the same time, the respective sliver is moved in the sliver direction. However, the S and Z twists can also be created by means of an aerodynamic, in particular pneumatic, method.

The alternating S and Z twists are moreover interrupted by intermediate regions without any twist. The two slivers provided with S and Z twists in the same way are finally brought together at the so-called joining point. Here, the slivers start to twist together automatically, that is to say they wind around each other. This so-called double-folding maintains the S and Z twists in the individual slivers, so that a self-stabilizing two-component roving is obtained. In principle, however, care should be taken here to ensure that the regions without any twist in the first sliver should be arranged offset in the longitudinal direction relative to the regions without any twist in the second sliver, so that two regions without any twist in the first and second sliver never lie next to one another in the resulting roving, since the strength of the roving depends substantially on the phase position of the regions without any twist in the two slivers. As described above, the rovings are therefore always brought together by the consolidating means in such a way that their regions without any twist lie out of phase. The roving produced in this way ultimately has a greater strength than an untwisted fiber bundle, said strength ultimately being sufficient to wind the roving onto a bobbin and unwind it again from the latter without false drafts.

In general there is always the need with the associated spinning preparation machines to keep the space required to a minimum, but the spinning preparation machines must also still be easily accessible so that in particular it is possible to perform maintenance and adjustments and clear any errors after an undesired stop in the production of rovings.

SUMMARY OF THE INVENTION

An object of the present invention is therefore to provide a spinning preparation machine that is distinguished in this regard from the known prior art in a positive manner. Additional objects and advantages of the invention will be set forth in part in the following description, or may be obvious from the description, or may be learned through practice of the invention.

The objects are attained using a spinning preparation machine having the features described and claimed herein.

According to the invention, a spinning preparation machine, the consolidating means of which is preferably embodied as an air spinning nozzle and which works according to the aforesaid air-jet spinning method, is characterized in that the tube transport device comprises at least one conveyor (e.g. in the form of a conveyor belt) for transporting empty tubes and/or tubes loaded with a roving, wherein the conveyor(s), seen in a top view of the spinning preparation machine, are arranged at least in part between the feed segment of the guide for the fiber bundle and the drafting system.

The conveyor(s) of the tube transport device that are fixed, for example, on a shop floor of a shop accommodating the spinning preparation machine may include for instance a plurality of bobbin holders that each receive an empty tube or a tube loaded by means of the spinning preparation machine. The tube holders are movable for instance by moving the conveyor(s) between the spinning preparation machine and one or a plurality of collecting points for the empty or loaded tubes so that the spinning preparation machine may always be supplied with empty tubes and the loaded tubes may be removed from the spinning preparation machine.

As seen in a top view of the spinning preparation machine, the conveyor(s) guide the aforesaid tubes between the feed segment and the drafting system so that the space available between feed segment and drafting system may be used advantageously for placing some of the conveyor(s). The guide for the fiber bundle preferably comprises a track on which the fiber bundle is placed and thus is supported vertically. For instance, it would be possible to form the track using an elongate profile, consisting for instance of metal or plastic, that extends horizontally or in a direction slightly inclined from the horizontal between the feed segment and the delivery segment of the guide. The feed and delivery segments preferably each form an end segment of the guide, wherein the feed segment should be arranged in the region of the container (preferably thereabove) and the delivery segment should be arranged in the vicinity of the drafting system. In particular, the delivery segment should be disposed in the immediate vicinity of a feed roller for the drafting system in order to enable a nearly seamless transition between guide and drafting system. In general, it is also advantageous when the feed segment is placed higher than the delivery segment so that the guide forms a chute for the fiber bundle. In particular, it is advantageous when the guide extends perpendicular to the conveyor(s).

At this point, it should be pointed out in general that said consolidating means may be designed in various ways. For example, it would be conceivable that the consolidating means is suitable for producing the roving in the manner described in the abovementioned documents WO 2009/086646 A1 and DE 24 47 715 A1.

Preferably, however, the spinning preparation machine is designed as an air-jet spinning machine and the consolidating means is designed as an air spinning nozzle, by means of which the protective twist in the roving is created, as described above, by means of swirled air flows (part of such a spinning preparation machine designed as an air-jet spinning machine is described by way of example in the description of the figures).

Finally, it should be noted that the spinning preparation machine according to the invention may also include a plurality of units, each having a drafting system, a guide, a consolidating means (for instance in the form of the aforesaid air spinning nozzle), and a winding device, the conveyors having to run in this case between the drafting systems arranged in a row and the feed sections, also arranged in a row, of the guides, which preferably run parallel to one another.

There are also advantages if the spinning preparation machine comprises a tube transfer device that transfers tubes from the tube transport device to the winding device and/or vice versa. The tube transfer device may for instance comprise a tube gripper that is connected to a controller for the spinning preparation machine and that is embodied to move, preferably to lift, a loaded tube from the winding device onto a conveyor and an empty tube from a conveyor into or onto the winding device.

Moreover, it is advantageous when the conveyor(s), seen in a top view of the spinning preparation machine, run at least in part between the feed segment and the delivery segment of the guide. When the conveyor(s) are passing, the fiber bundle is supported, at least vertically, by the guide so that the fiber bundle is prevented from colliding with the conveyor(s) running preferably below the guide and the tubes thereupon. It is in particular advantageous when the conveyor(s) in the aforesaid top view run(s) between the feed segment of the guide and the winding device and/or between the feed segment of the guide and the tube transfer device. In this case, in the aforesaid top view, the feed segment is disposed on the one side of the conveyor(s) that run(s) preferably perpendicular to the guide, while the winding device and/or the tube transfer device is disposed on the other side of the conveyor(s). Finally, it may also be advantageous when the conveyor(s), in the top view of the spinning preparation machine, run between the feed segment of the guide and the consolidating means, the consolidating means being disposed with respect to the conveyor(s) preferably on the same side as the delivery segment of the guide, the winding device, and/or the tube transfer device.

It is also advantageous when the guide completely spans the conveyor(s), which, seen in a top view of the spinning preparation machine, are arranged below the guide, and preferably span the entire region of the tube transport device arranged below the guide in the aforesaid top view. In this case, the guide is embodied as a bridge element so that the fiber bundle, supported by the guide, is guided above the conveyor(s) and the tubes guided thereupon, so that the free space actually disposed in this region may be used for transporting the fiber bundle. The guide may also have one or a plurality of frames via which it is supported with respect to a shop floor or a carrier segment of the spinning preparation machine, the frame or frames preferably being disposed, in the top view of the spinning preparation machine, to the side of the conveyor(s).

It is thus advantageous when the feed segment, the delivery segment, and/or a guide segment of the guide disposed therebetween, in a side view of the spinning preparation machine, are arranged above at least a portion of the conveyor(s) running, in a top view, between the feed segment of the guide and the drafting system, wherein the vertical distance between the guide conveyor(s) and one or a plurality of the aforesaid segments of the guide are preferably longer than 30 cm, more preferably longer than 40 cm, particularly preferably longer than 50 cm, in order to be able to rule out a collision between the guide and the tubes transported below it. Finally, the feed segment, the delivery segment, and/or the guide segment of the guide disposed therebetween in the aforesaid side view of the spinning preparation machine are also preferably arranged above at least a portion of the drafting system and/or the consolidating means and/or the tube transfer device.

It is also advantageous when the winding device and/or the tube transfer device, in a top view and/or side view of the spinning preparation machine, are arranged at least in part between the feed segment of the guide and the consolidating means. The consolidating means may be arranged in the area of a front, end-face end region of the spinning preparation machine, while the feed segment may be disposed in the region of a second, rear end-face end segment, wherein the aforesaid end segments should be placed on opposing sides of the conveyor(s). Finally, it is also conceivable for the winding device and/or the tube transfer device to be arranged, in the aforesaid top view and/or side view, at least in part between the feed segment of the guide and the drafting system. The available space for the spinning preparation machine may be utilized in a particularly efficient manner, wherein the individual components of the spinning preparation machine also continue to be easily accessible.

It is particularly advantageous when the winding device and/or the tube transfer device are arranged at least in part below the guide, below the drafting system, and/or below the consolidating means. In the side view of the spinning preparation machine, the guide, and preferably also the consolidating means, are thus arranged above the winding device and the tube transfer device disposed in particular at about the same height. In this case, the fiber bundle is guided horizontally or on a downward incline via the guide into the drafting system. From there it travels, preferably on a downward incline, into the consolidating means. The roving manufactured there from the fiber bundle is finally wound onto a tube by means of the winding device (which is preferably disposed near the floor of the shop floor that bears the spinning preparation machine), and the tube is finally transferred to the tube transport device, which is also disposed near the floor, by means of the tube transport unit.

It is advantageous when the feed segment of the guide is spaced horizontally at least 50 cm from a feed roller of the drafting system, preferably at least 100 cm, particularly preferably at least 150 cm. The drafting system preferably includes a plurality of drafting system roller arrangements, each of which includes a roller and at least one counter-roller, to be able to guide the fiber bundle between rollers and corresponding counter-rollers in a clamped manner. If the distance between one of the feed rollers (i.e. the rollers in the drafting system that are immediately adjacent to the delivery segment of the guide) and the feed segment is established according to the above, then the conveyor(s) (in the top view of the spinning preparation machine) may run with no problem between feed segment and feed roller.

It is particularly advantageous when the drafting system and the guide and/or the drafting system and the winding device and/or the drafting system and the tube transfer device are arranged, in a side view of the spinning preparation machine, seen horizontally, on the same side of the consolidating means. In the aforesaid side view, seen horizontally, the consolidating means is preferably farthest from the conveyor(s). After leaving the consolidating means, the roving is preferably diverted from the horizontal towards the winding device and/or the tube transport device and runs, at least in the horizontal direction, counter to the transport direction of the fiber bundle guided in the region of the guide.

It is also advantageous when the winding device, the tube transfer device, the drafting system, the guide, and/or the belts(s) are arranged, in a front view of the spinning preparation machine, at least in part behind the consolidating means. In particular, when all of the aforesaid units (with the exception of the consolidating means) are disposed behind the consolidating means, the latter is easily accessible from the front. Fiber residues located in the consolidating means may be easily removed from the consolidating means after an unintentional interruption in the production of rovings. It is furthermore an advantage when, in the aforesaid front view, the conveyor(s) runs or run behind the consolidating means, the winding device and the tube transfer device so that this/these conveyor(s) is/are accessible from behind.

It is particularly advantageous when the feed segment, in a front view of the spinning preparation machine, is arranged behind the drafting system, behind the delivery segment of the guide, behind the winding device, behind the tube transfer device, behind at least one conveyor, and/or behind the entire tube transport device running below the guide. In this case the feed segment is easily accessible from behind so that the fiber bundle may be removed from a container providing the fiber bundle and may be fed to the guide with no problem.

BRIEF DESCRIPTION OF THE DRAWINGS

Further advantages of the invention are described in the following exemplary embodiments, in which.

DETAILED DESCRIPTION

Figure 1:
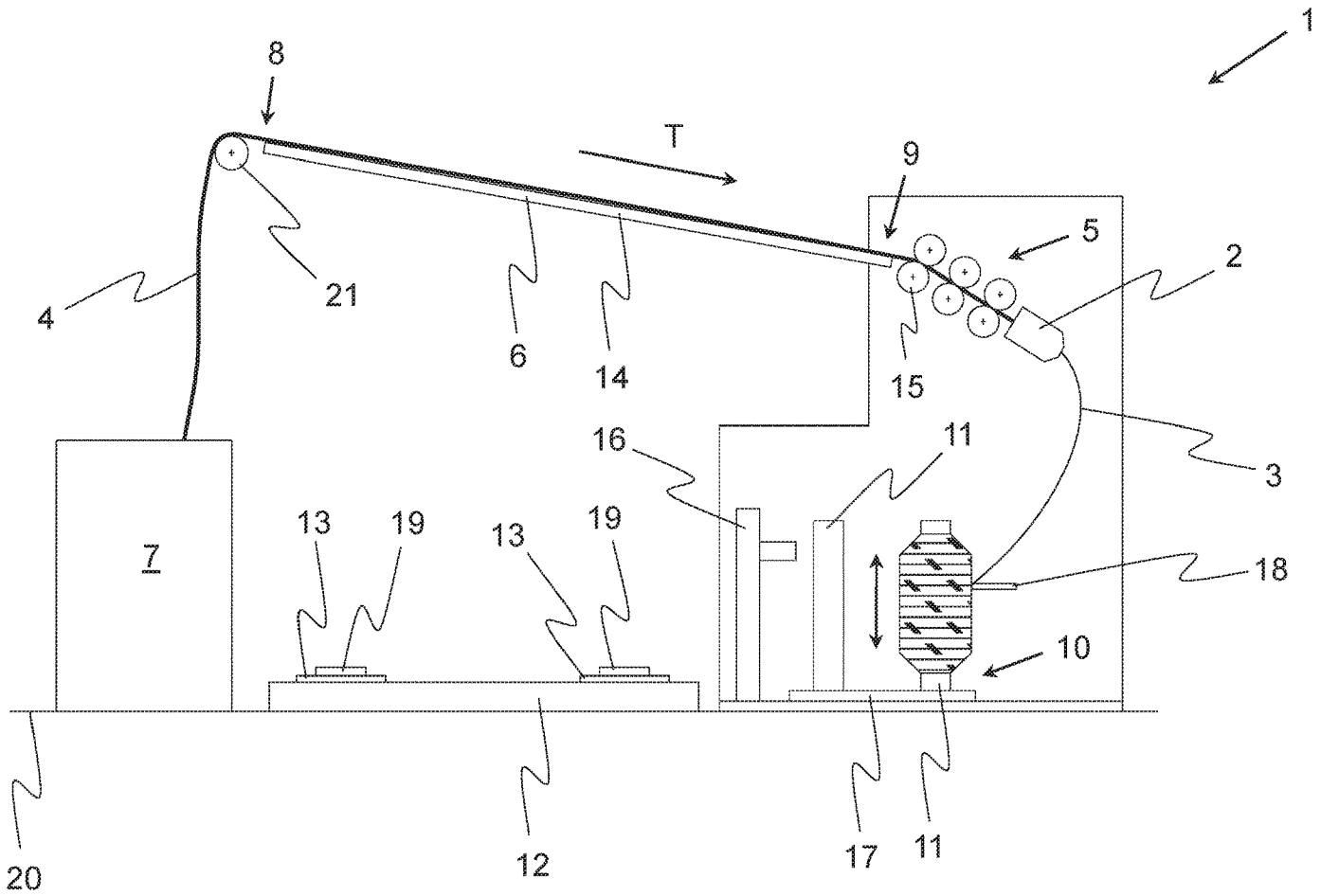
FIG. 1 is a side view of a spinning preparation machine according to the invention, and, FIG. 2 is a top view of a spinning preparation machine according to the invention.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 is a schematic side view of a spinning preparation machine 1 according to the invention in the form of an air-jet spinning machine that stands on a shop floor 20 and produces roving 3. The spinning preparation machine 1 preferably comprises a drafting system 5 with a plurality of corresponding drafting system rollers (only one of the two feed rollers 15 arranged in the input area of the drafting system 5 is provided with a reference number) that is supplied with a fiber bundle 4, for instance in the form of a doubled drafter sliver.

The fiber bundle 4 generally originates from a container 7 (e.g. a sliver can) and is fed to the drafting system 5, preferably after passing over a guide roller 21, via a guide 6, wherein the guide 6 may be embodied for instance as a longitudinal profile. In principle the guide 6 comprises a feed segment 8 adjacent to the container 7, a delivery segment 9 adjacent to the drafting system 5, and a guide segment 14 disposed therebetween for supporting the fiber bundle 4 at least from below.

The illustrated spinning preparation machine 1 also comprises a consolidating means, spaced apart from the drafting system 5. In the embodiment of FIG. 1, the consolidating means is in the form of an air spinning nozzle 2 having an internal vortex chamber (known from prior art and therefore not shown) and a yarn-forming element (likewise known from the prior art and therefore likewise not shown) in the form of a hollow spindle that projects into the vortex chamber. In the vortex chamber, the fiber bundle 4 or at least a portion of the fibers in the fiber bundle 4 are provided with a protective twist by means of a swirled air flow generated by air nozzles in the vortex chamber.

The spinning preparation machine 1 may furthermore comprise a draw-off unit for the roving 3, with preferably two draw-off rollers, downstream of the drafting system 5 in the transport direction T (the draw-off unit is not absolutely necessary and is therefore not shown in the drawings). Moreover, a winding device 10 is present that preferably receives at least two tubes 11 and with which it is possible to wind the roving 3 onto a tube 11, the roving 3 being guided by means of a traversing unit 18 that can be moved back and forth in the direction of the double arrow shown in FIG. 1. The winding device 10 may in particular comprise a platform 17 that can be rotated by means of a drive and on which the tubes 11 may be fixed using corresponding holding devices (not shown), wherein the holding devices, and thus also the respective tubes 11, may be caused to rotate, preferably via separate drives.

The spinning preparation machine 1 depicted and embodied as an example as an air-jet spinning machine works according to a special air-jet spinning method. For forming the roving 3, the fiber bundle 4 is guided in the aforesaid transport direction T via an inlet opening (not shown) into the vortex chamber of the air spinning nozzle 2. There it is given a protective twist, that is to say at least a portion of the fibers of the fiber bundle 4 is grasped by the aforesaid swirled air flow, which is created by suitably placed spinning air channels. A portion of the fibers is thereby pulled at least a little way out of the fiber bundle 4 and is wound around the tip of the yarn forming element which protrudes into the vortex chamber.

Finally, the fibers of the fiber bundle 4 are drawn out of the vortex chamber via an inlet opening of the yarn forming element and a draw-off channel which is arranged inside the yarn forming element and adjoins the inlet opening. In doing so, the free fiber ends are finally also drawn on a helical trajectory in the direction of the inlet opening and wrap as wrapping fibers around the centrally running core fibers, resulting in a roving 3 which has the desired protective twist.

Due to the only partial twisting of the fibers, the roving 3 has a draftability which is essential for the further processing of the roving 3 in a downstream spinning machine, for example a ring spinning machine. Conventional air-jet spinning devices, on the other hand, give the fiber bundle 4 such a pronounced twist that the required drafting following yarn production is no longer possible. This is also desired in this case since conventional air-jet spinning machines 1 are designed to produce a finished yarn, which is generally intended to be characterized by a high strength.

As explained in the foregoing, after leaving the air spinning nozzle 2, the roving 3 is wound onto a tube 11 by means of the winding device 10. If the specific tube 11 is adequately loaded with roving 3, it is exchanged for an empty tube 11, wherein the aforesaid platform 17 is rotated for this purpose about a preferably vertical rotational axis until the empty tube 11 shown in FIG. 1 is disposed in the position of the loaded tube 11 shown in FIG. 1 and vice versa.

While the empty tube 11 is being loaded with roving 3 following this tube exchange, a tube transfer device 16 is activated that transfers the loaded tube 11 to a conveyor 13 (for instance in the form of a conveyor belt) of a tube transport device 12 that finally transports the tube 11 to a removal location (not shown). This conveyor 13, a plurality of which may be present, preferably includes a plurality of tube holders 19 by which the tubes 11 may be held during their transport. Once the loaded tube 11 has been transported away, the position on the platform 17 of the winding device 10 that has been freed up by this may be occupied by a new, empty tube 11, the tube transfer device 16 preferably accomplishing this.

Alternatively, it would also naturally be possible to eliminate the tube transfer device 16. Likewise, the winding device 10 could also have only one holding device for one tube 11.

Figure 2:
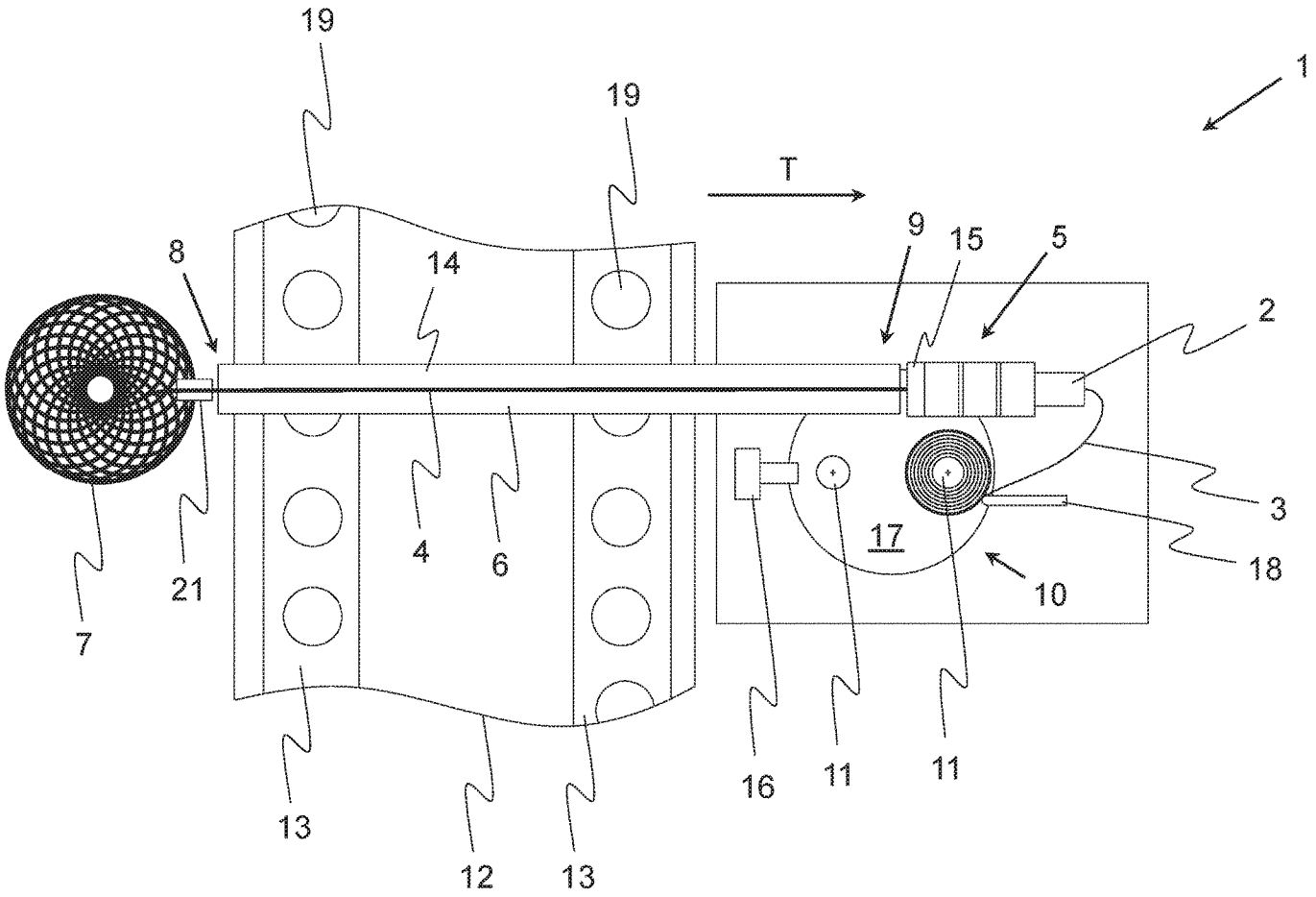

In accordance with the invention, it is now suggested that, in a top view of the spinning preparation machine 1 shown in FIG. 2, the conveyor(s) 13 is or are arranged, at least in part between the feed segment 8 of the guide 6 and the drafting system 5. In particular the conveyor(s) 13 should be supported in the area of the so-called shop floor 20 so that it/they, in the side view of the spinning preparation machine 1 shown in FIG. 1, is/are disposed below the guide 6.

In addition, it is advantageous when the conveyor(s) 13 is/are arranged between the feed segment 8 of the guide 6 or the container 7 and the delivery segment 9 of the guide 6, the guide 6 spanning the conveyor(s) 13 in a bridge-like manner. The fiber bundle 4 is now guided from behind via the conveyor(s) 13 and finally travels in the front region of the spinning preparation machine 1 into the drafting system 5 and ultimately into the air spinning nozzle 2.

As FIG. 2 shows, the winding device 10, the traversing unit 18, and the tube transfer device 16 may be arranged to the side of the drafting system 5 or air spinning nozzle 2. In this case, the result is a particularly space-saving arrangement of the individual elements.

Furthermore, the drafting system 5, the air spinning nozzle 2, and also the guide 6 should be placed above the winding device 10, the traversing unit 18, the tube transfer device 16, and/or the conveyor(s) 13 to utilize the free space above the aforesaid elements.

Finally, the above description is referenced with respect to the possible mutual arrangements of the individual segments (feed segment 8, guide segment 14, delivery segment 9, drafting system 5, air spinning nozzle 2, traversing unit 18, winding device 10, tube transfer device 16, conveyor(s) 13) so that the mutual arrangement depicted in the drawings shall be construed only as an example.

The present invention is not limited to the exemplary embodiments that have been shown and described. Modifications within the scope of the patent claims are also possible, as is any combination of the described features, even if they are shown and described in different parts of the description or the claims or in different exemplary embodiments.

REFERENCE LIST

1 Spinning preparation machine
2 Air spinning nozzle
3 Roving
4 Fiber bundle
5 Drafting system
6 Guide
7 Container
8 Feed segment
9 Delivery segment
10 Winding device
11 Tube
12 Tube transport device
13 Conveyor
14 Guide segment
15 Input roller
16 Tube transfer device
17 Platform
18 Traversing unit
19 Tube holder
20 Shop floor
21 Guide roller
T Transport direction

The invention claimed is:

1. A spinning preparation machine, comprising:

a consolidating means for producing a roving with a protective twist from a fiber bundle supplied to the consolidating means;

a drafting system upstream of the consolidating means in a transport direction of the fiber bundle to draft the fiber bundle;

a guide arranged longitudinally between the drafting system and a container that provides the fiber bundle to the drafting system, the guide comprising a feed segment opposite from the drafting system and a delivery segment;

a winding device disposed downstream of the consolidating means to wind the roving onto a tube;

a tube transport device disposed to provide empty tubes to the winding device or remove tubes loaded with roving from the winding device;

wherein the tube transport device comprises at least one conveyor to transport the empty tubes or remove the tubes loaded with roving, the conveyor operatively arranged at least in part between the feed segment of the guide and the drafting system;

a tube transfer device operatively disposed to transfer the empty tubes from the tube transport device to the winding device or the tubes loaded with roving from the winding device to the transport device; and wherein one or both of the winding device or the tube transfer device are arranged at least in part between the feed segment of the guide and the consolidating means, or between the feed segment of the guide and the drafting system.

2. The spinning preparation machine according to claim 1, wherein the consolidating means comprises an air spinning nozzle, wherein the roving is produced from the fiber bundle inside the air spinning nozzle by a swirled air flow.

3. The spinning preparation machine according to claim 2, wherein the conveyor is disposed between the feed segment of the guide and one of: the delivery segment; the winding device; the tube transfer device; or the consolidating means.

4. The spinning preparation machine according to claim 2, wherein the guide completely spans over and across the conveyor and tube transport device.

5. The spinning preparation machine according to claim 2, wherein one or more of the following are arranged above the conveyor: the feed segment of the guide, the delivery segment of the guide, the consolidating means, or the tube transfer device.

6. The spinning preparation machine according to claim 2, wherein one or both of the winding device or the tube transfer device are arranged at least in part below one or all of the guide, the drafting system, or the consolidating means.

7. The spinning preparation machine according to claim 1, wherein the feed segment of the guide is spaced horizontally at least 50 cm from a feed roller of the drafting system.

8. The spinning preparation machine according to claim 2, wherein, in a side view, the drafting system and one or more of the following are arranged along a common side of the consolidating means: the guide, the winding device, or the tube transfer device.

9. The spinning preparation machine according to claim 2, wherein, in a front end view, one or more of the following are arranged behind the consolidating means: the winding device, the tube transfer device, the drafting system, the guide, or the conveyor.

10. The spinning preparation machine according to claim 2, wherein, in a front end view, the feed segment of the guide is arranged behind one or more of the following: the drafting system, the delivery segment of the guide, the winding device, the tube transfer device, the conveyor, or the tube transport device.

11. A spinning preparation machine, comprising:

a consolidating means for producing a roving with a protective twist from a fiber bundle supplied to the consolidating means;

a drafting system upstream of the consolidating means in a transport direction of the fiber bundle to draft the fiber bundle;

a guide arranged longitudinally between the drafting system and a container that provides the fiber bundle to the drafting system, the guide comprising a feed segment opposite from the drafting system and a delivery segment;

a winding device disposed downstream of the consolidating means to wind the roving onto a tube;

a tube transport device disposed to provide empty tubes to the winding device or remove tubes loaded with roving from the winding device;

wherein the tube transport device comprises at least one conveyor to transport the empty tubes or remove the tubes loaded with roving, the conveyor operatively arranged at least in part between the feed segment of the guide and the drafting system;

a tube transfer device operatively disposed to transfer the empty tubes from the tube transport device to the winding device or the tubes loaded with roving from the winding device to the transport device; and wherein one or more of the following are arranged above the conveyor: the feed segment of the guide, the delivery segment of the guide, the consolidating means, or the tube transfer device.

12. A spinning preparation machine, comprising:

a consolidating means for producing a roving with a protective twist from a fiber bundle supplied to the consolidating means;

a drafting system upstream of the consolidating means in a transport direction of the fiber bundle to draft the fiber bundle;

a guide arranged longitudinally between the drafting system and a container that provides the fiber bundle to the drafting system, the guide comprising a feed segment opposite from the drafting system and a delivery segment;

a winding device disposed downstream of the consolidating means to wind the roving onto a tube;

a tube transport device disposed to provide empty tubes to the winding device or remove tubes loaded with roving from the winding device;

wherein the tube transport device comprises at least one conveyor to transport the empty tubes or remove the tubes loaded with roving, the conveyor operatively arranged at least in part between the feed segment of the guide and the drafting system;

a tube transfer device operatively disposed to transfer the empty tubes from the tube transport device to the winding device or the tubes loaded with roving from the winding device to the transport device; and wherein one or both of the winding device or the tube transfer device are arranged at least in part below one or all of the guide, the drafting system, or the consolidating means.

* * * * *